United States Patent [19]

Borner et al.

[11] 4,147,597

[45] Apr. 3, 1979

[54] METHOD FOR PRODUCING ELECTROLYTIC NICKEL IN PARTICULATE FORMS UNDER CONDITION OF HIGH AND VARIABLE INTERNAL STRESS

[75] Inventors: William G. Borner, Ringwood, N.J.; Aloys J. Dill, Tappan, N.Y.; Gordon L. Fisher, Mahwah, N.J.

[73] Assignee: The International Nickel Company, Inc., New York, N.Y.

[21] Appl. No.: 879,728

[22] Filed: Feb. 21, 1978

[51] Int. Cl.[2] ..... C25D 1/04; C25D 17/12

[52] U.S. Cl. ..... 204/12; 204/281

[58] Field of Search ..... 204/12, 281, 3, 4, 112

[56] References Cited

U.S. PATENT DOCUMENTS

| | | | |
|---|---|---|---|
| 3,577,330 | 5/1971 | Knapp et al. | 204/112 |
| 3,668,081 | 6/1972 | Borner | 204/12 |
| 3,883,411 | 5/1975 | Gendron et al. | 204/12 |
| 4,040,915 | 8/1977 | Fisher | 204/281 |

FOREIGN PATENT DOCUMENTS 955195 9/1974 Canada.

*Primary Examiner*—T. M. Tufariello

*Attorney, Agent, or Firm*—Ewan C. MacQueen; Francis J. Mulligan, Jr.

[57] ABSTRACT

An electrodeposition mandrel for nickel electrodeposition having islands of bare metal surface finished by grit blasting with either cast iron grit or aluminum oxide grit to a RMS surface finish of about 130 to 300μ inch when cast iron grit is employed and about 25 to about 150μ inch when aluminum oxide grit is employed.

5 Claims, 2 Drawing Figures

METHOD FOR PRODUCING ELECTROLYTIC NICKEL IN PARTICULATE FORMS UNDER CONDITION OF HIGH AND VARIABLE INTERNAL STRESS

The present invention is concerned with electrodeposition mandrels and, more particularly, with mandrels employed in the electrodeposition of nickel.

PRIOR ART AND BACKGROUND OF THE INVENTION

A number of disclosures such as those set forth in U.S. Pat. Nos. 3,577,330; 3,668,081; 3,883,411 and Canadian Pat. No. 955,195 deal with cathode mandrels for electrodeposition of nickel. In general these disclosures teach use of mandrels made of stainless steel, titanium and aluminum which are sand blasted to defined surface finishes in terms of microinches (as measured by a profilometer) in interrelationship with internal stress levels of nickel deposited on such mandrels.

The teachings of these prior patents have not been entirely successful when carried into practice on a commercial scale. The object of these teachings is to provide mandrels which cause adherence of nickel deposits during electrodeposition and ready removal of the deposits when the deposition is finished. The problem which arises in commercial production is that it is not possible to maintain the internal stress level of electrodeposited nickel constant over any extended periof of time. For reasons both known and unknown the electrolyte composition may vary from day to day and from week to week. These variations can be meaningless in terms of purity and quality of product produced but can be highly significant in terms of adherence of the deposited nickel to the mandrels. Under conditions of low internal stress, a high degree of mandrel roughness will cause too much adherence and it will be difficult to remove the electrodeposited nickel from the mandrel. On the other hand, under condition of high internal stress, too little mandrel roughness will be ineffective in terms of adherence of the deposited nickel to such mandrels.

What is needed then for commercial use are mandrels surface finished in such a way as to be broadly tolerant of unavoidable variations in internal stress of nickel electrodeposits.

DISCOVERY, OBJECTS AND DRAWINGS

It has now been discovered that by means of special controls of surface finishing to provide specifically describable surface profiles, mandrels can be provided which have significantly broad tolerance for variations in internal stress of electrodeposited nickel.

It is an object of the present invention to provide a novel mandrel for electrodeposition of nickel having the ability to maintain adherence of the electrodeposited nickel during electrodeposition and to provide ready release of the electrodeposit upon completion of electrodeposition.

Figure 1:
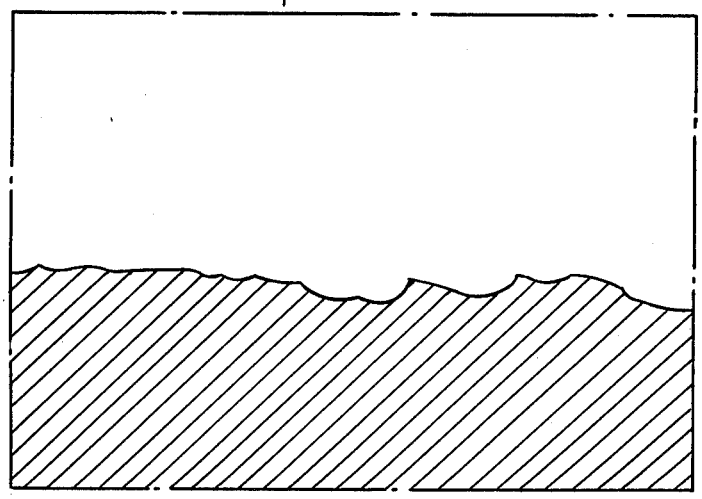

Other objects and advantages will become apparent from the following description taken in conjunction with the drawings in which:

FIG 1 schematically depicts a mandrel surface blasted with cast iron grit; and

Figure 2:
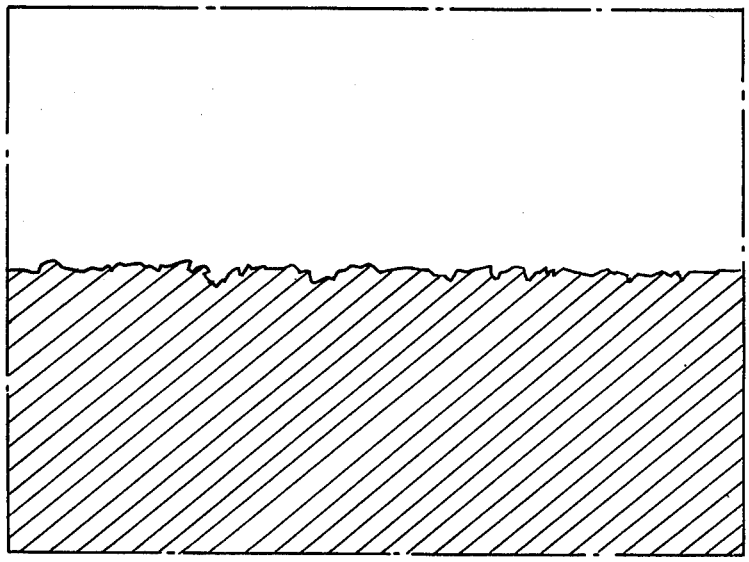

FIG. 2 schematically depicts a mandrel surface blasted with aluminum oxide grit.

GENERAL DESCRIPTION

Generally speaking, the present invention contemplates a reusable electrodeposition mandrel comprising a plurality of islands of electrically interconnected, bare, inert metal positioned in essentially planar array and surrounded in essentially the plane of said array by electrical insulating material and means for connecting said islands into a direct current circuit, said bare metal islands having a surface finish produced by grit blasting by either aluminum oxide grit or cast iron grit thereby providing on said bare metal islands a plurality of sharply defined micro indentations ranging from cup-shape to pyramidal shape, the average surface roughness of the islands being about 130 to about 300 micro inches (about 3.3 to 7.6$\mu$) when cast iron grit is employed and about 25 to 150 micro inches (about 0.6 to 3.8$\mu$) when aluminum oxide grit is employed.

Electrodeposition mandrels of the present invention can be conveniently in the form of a sheet of inert metal having hangers at one end and being coated with an electrically insulating coating (e.g., epoxy paint) on both faces of the sheet except for exposed islands of bare, inert metal. Such mandrels are generally disclosed in the U.S. patents mentioned hereinbefore. Alternatively the mandrel may comprise a built-up structure of inert metal units defining electrically connected islands with the whole of the structure except for the exposed and hangers or other electrical contact means being embedded in an insulator such as a plastic. Mandrels of this type are disclosed in South African application Ser. No. 76/6898 filed by Falconbridge Nickel Mines Limited in the names of Ronald Parkinson and Richard Allan Sinton inventors.

Surface finishing of mandrel metals such as type 304 stainless steel to produce mandrels in accordance with the present invention can be carried out in any convenient apparatus which will uniformly abrade the metal surface and, in which, the character of the abrasive can be controlled. Good results have been obtained using wheel-type centrifugal blast units such as made by Wheelabrator-Frye, Inc. coupled with abrasive return means including screens for discarding undersize abrasive grains. Similar good results are obtained using air blast apparatus such as produced by Zero Manufacturing Company again provided that means are provided for maintaining the abrasive grain size constant.

Contrary to the teachings of the prior art it has been found that sand blasting is not a satisfactory way of surface finishing mandrels. Our investigations have determined that sand fragments too readily during blasting operations so that it is very difficult to maintain a fixed grain size with sand. In addition, the fragmentation of the sand grain which occurs on impact with the metal surface causes the microindentation into the metal surface to have a rounded off perimeter rather than a sharply defined perimeter such as produced when iron grit or aluminum oxide is used as the abrasive. The exact type of surface morphology produced by the surface finishing determines the range of surface roughnesses which will be operative on mandrels used in nickel electrowinning or electrorefining. Cast iron grit produces cup-shaped micro-indentations on a mandrel surface as depicted in FIG. 1 of the drawing. Useful mandrel surfaces having 1 inch (2.5 cm) diameter exposed metal areas for nickel electrodeposition are produced by blasting with cast iron grit to a RMS surface roughness of about 130 to 300 micro-inches ($\mu$ inch) (about 3.3 to 7.6μ). Mandrels of such configuration will satisfactorily handle nickel electrodeposits having internal stresses in the range of about 20,000 to 100,000 psi (i.e., 150 to 700 megapascals MPa). Nickel rounds one inch in diameter electrodeposited on such a mandrel will resist a pull of 25 pounds (11.36 kilograms) in a direction perpendicular to the plane of the mandrel and will be detached from the mandrel by a similar pull of 100 pounds (45.45 kilograms). It has been found that nickel rounds having adhesion characteristics so measured will adhere to the mandrel during electrodeposition and be readily removed from the mandrel at the end of electrodeposition.

Similar results are obtained with mandrels blasted with aluminum oxide grit except that the RMS surface roughness must be in the range of about 25 to about 150μ inches (about 0.6 to 3.8μ). The reason that the smoother aluminum oxide blasted surface appears to act the same as the rougher surface resulting from cast iron grit blasting seems to be that the surface indentations produced by aluminum oxide are angular and pyramidal in shape giving more efficient keying of electrodeposited metal to the mandrel surface. The angular pyramidal shape of the aluminum oxide produced indentations is shown in FIG. 2 of the drawing.

In order to provide a better understanding of the invention the following examples are given:

EXAMPLE I

Type 304 stainless steel sheets, 3mm thick, were grit blasted on both sides using sizes 25, 40, 50, 80 or 120 cast iron grits. The blasted sheets were cut to size of 18 cm by 23 cm provided with electrical contact means and printed with epoxy ink to produce a pattern of 2.54 cm diameter starting circles on 3.5 cm centers. Chromium plating was used to bond the epoxy ink to the mandrels. After printing and curing, the chromium was removed from the starting circles by anodic dissolution in dilute caustic solution (45 g/liter NaOH).

The mandrels were plated in a 40-liter simulated refinery bath containing:

285 g/liter $NiSO_4.6H_2O$
35 g/liter $NiCl_2.6H_2O$
75 g/liter NaCl
20 g/liter $H_3BO_3$ The bath temperature was maintained at 60° C. (140° F.) and pH was maintained between 3.5 and 4.0. A stirrer was used for solution agitation. The starting cathode current density was 648 A/m$^2$. The cell current was maintained at the starting value as the rounds grew over a period of 6 days. sulfur-containing nickel rounds were used for anode material.

Internal stress was controlled at specific levels using p-toluenesulfonamide. It was added via a solution metering pump at rates required to maintain internal stress levels of approximately 0, 175 and 325 MPa. No stress reducer was needed to maintain internal stress at 480 MPa. Internal stress measurements were made directly in the 40-liter bath using the Brenner-Senderoff spiral contractometer located between two parallel anodes. A current density of 648 A/m$^2$ was used and the deposit was grown to a thickness of only 5μ (0.2 mil) in order to give an accurate indication of stress levels at the start of the round growth.

Adhesion of rounds was determined by measuring the force needed to pull rounds off the mandrel in the direction normal to the plane of the mandrel using conventional tensile test equipment. The rounds were pulled by fastening bolts to them with an epoxy cement. The bolts could then be gripped by the tensile test machine. A mandrel surface that required more than about 450 N to remove rounds was considered to provide excess adhesion. These rounds were generally very difficult to remove. A mandrel surface that required less than about 100 N to remove the rounds was considered to provide insufficient adhesion. Rounds would often fall off these mandrels before testing.

It was found that with a RMS surface roughness of about 5 to 6μ (about 180-230μ inch) as measured by a PROFILOMETER® surface roughness analyzer satisfactory adhesion was obtained at all internal stress levels of the nickel electrodeposit from about 100 to about 500 MPa.

EXAMPLE II

Mandrels of the same form and size as those in Example I were blasted with aluminum oxide using air blasting equipment coupled with grit classifying return means to control the size of the grit fed to the blasting units. These Mandrels were masked and nickel was electrodeposited on the unmasked mandrel surfaces in the same manner and from the same type bath used in Example I. Testing in a manner the same as testing in Example I resulted in a finding that mandrels having an RMS surface roughness of about 45 to 60μ inch RMS were satisfactory for deposition of nickel rounds having internal stresses of about 325 MPa (45,000 psi).

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An electrodeposition mandrel for nickel comprising a plurality of electrically interconnected small area surfaces in planar array made of a metal inert to nickel electrolyte surrounded in essentially the plane of said array by electrically insulating material and means to connect said surfaces into a direct current electric circuit said surfaces having a surface finish produced by grit blasting with a grit selected from the group of aluminum oxide grit and cast iron grit thereby providing a plurality of sharply defined micro indentations, each indentation being of a shape ranging from cup-shape to pyramidal shape, said surface finish being of about 25 to about 150 microinches RMS when produced by aluminum oxide blasting and being about 130 to about 300 microinches RMS when produced by cast iron grit blasting.

2. An electrodeposition mandrel as in claim 1 wherein the small area surfaces in planar array are unmasked areas on a masked planar metal sheet.

3. An electrodeposition mandrel as in claim 2 wherein the metal of the sheet is titanium or stainless steel.

4. An electrodeposition mandrel as in claim 3 wherein the metal is stainless steel and the small area surfaces are each essentially round and about 2.5 cm in diameter.

5. In the commercial electrodeposition of nickel on reusable permanent mandrels from which nickel deposits are removed upon completion of electrodeposition, the improvement comprising employing in said electrodeposition the mandrel of claim 1.

* * * * *